US006980765B2

(12) United States Patent
McStravick et al.

(10) Patent No.: US 6,980,765 B2
(45) Date of Patent: Dec. 27, 2005

(54) DUAL POLARITY ELECTROSTATIC BRUSH CLEANER

(75) Inventors: Mary L. McStravick, Fairport, NY (US); Paul W. Morehouse, Jr., Webster, NY (US)

(73) Assignee: Xerox Corporation, Stamford, CT (US)

( * ) Notice: Subject to any disclaimer, the term of this patent is extended or adjusted under 35 U.S.C. 154(b) by 48 days.

(21) Appl. No.: 10/721,845

(22) Filed: Nov. 25, 2003

(65) Prior Publication Data

US 2005/0111893 A1 May 26, 2005

(51) Int. Cl.[7] ..... G03G 21/00

(52) U.S. Cl. ..... 399/354; 399/358

(58) Field of Search ..... 399/71, 343, 349, 399/353, 354, 358; 15/1.51, 21, 88.2, 88.3, 15/100, 159.1, 21.1

(56) References Cited

U.S. PATENT DOCUMENTS

| | | | | |
|---|---|---|---|---|
| 3,572,923 | A * | 3/1971 | Fisher et al. | 399/358 |
| 4,361,922 | A * | 12/1982 | Karal | 15/1.51 |
| 4,673,284 | A * | 6/1987 | Matsumoto et al. | 15/1.51 X |
| 4,835,807 | A * | 6/1989 | Swift | 15/1.51 |
| 4,999,679 | A * | 3/1991 | Corbin et al. | 399/354 |
| 5,623,721 | A * | 4/1997 | Lindblad et al. | 399/354 |
| 5,655,204 | A * | 8/1997 | Siegel | 399/349 |
| 5,771,424 | A * | 6/1998 | Lindblad et al. | 399/354 X |
| 6,073,294 | A * | 6/2000 | Mashtare et al. | 15/1.51 |
| 6,169,872 | B1 * | 1/2001 | Thayer | 399/354 |

* cited by examiner

*Primary Examiner*—Sandra L. Brase
(74) *Attorney, Agent, or Firm*—Lloyd F. Bean, II

(57) ABSTRACT

An apparatus for removing charged particles from a surface, the surface being capable of movement, including: a conductive brush in contact with the surface, the conductive brush having a first region thereof having a first polarity and a second region having a second polarity; the conductive brush includes a core and conductive fibers attached thereto, the core being electrically segmented into the first region and the second region.

9 Claims, 2 Drawing Sheets

DUAL POLARITY ELECTROSTATIC BRUSH CLEANER

This invention relates to an electrostatographic printer or copier, and more particularly concerns a cleaning apparatus for removing toner from an imaging surface.

Electrostatic brush (ESB) cleaners are designed to satisfy a requirement of cleaning a maximum toner mass entering the cleaner in a given number of passes through the cleaner. Generally these requirements are a maximum single pass cleaning requirement and a maximum two pass cleaning requirement. The single pass cleaning requirement is typically the residual toner mass on the photoreceptor belt following transfer under conditions of the highest developed mass (DMA) with the lowest transfer efficiency (TE). In some machines a mark-to-edge, or bleed edge, requirement raises the single pass cleaning requirement to the highest DMA level. The two pass cleaning requirement is typically cleaning of untransferred control patches and/or untransferred images in jam recovery. These input densities are equal to the highest DMA. It has been demonstrated that a two pass cleaning requirement is equivalent to cleaning half of the required toner mass in a single pass.

The two pass cleaning requirement, except in the case of mark-to-edge machines, is much more stressful than the single pass cleaning requirement. Therefore, the cleaning brushes are designed to clean the two pass requirement. Half of the toner is cleaned in each pass through the cleaner. In designing the cleaner the speed of the brushes, the number of fibers on the brushes, the interference of the brushes to the photoreceptor, the electrical bias on the brushes and the number of brushes are chosen to clean the equivalent single pass toner input.

Conventional multiple electrostatic brush cleaners consist of two or more brushes electrically biased to remove toner and other debris from the photoreceptor surface. Prior to the brushes a preclean charge device adjusts the toner charge of the incoming toner to the natural tribo charging polarity of the toner. This is known as right sign toner. Toner that does not charge to the polarity of the majority of the toner in the preclean charging step is known as wrong sign toner. The first brushes are biased opposite to the polarity of the right sign toner so that this toner can be removed. The last cleaning brush is biased opposite to the first brushes so that the wrong sign toner can be removed. Since there is only a small percentage of the toner that is wrong sign only a single brush is ever needed to clean the wrong sign toner mass.

Conventional multiple electrostatic brush cleaners have their single pass toner cleaning capacity limited by the amount of right sign toner that can be cleaned by the first brushes and the amount of wrong sign toner that can be cleaned by the last brush. As more cleaning capacity is required, such as for an increase in machine process speed, additional right sign cleaning brushes or additional cleaning passes must be added. These additions to the cleaning system are undesirable. Additional cleaning brushes increase the size and cost of the cleaner and may not fit in the available machine space. Additional cleaning passes decrease the productivity of the machine by requiring a longer recovery from paper jams. Additional cleaning passes impact the xerographic control of the machine by requiring a longer time to clean process control patches.

Briefly stated, and in accordance with one aspect of the present invention, there is provided An apparatus for removing charged particles from a surface, the surface being capable of movement, comprising: a conductive brush in contact with said surface, said conductive brush having a first region thereof having a first polarity and a second region having a second polarity; and mean for biasing said conductive brush.

BRIEF DESCRIPTION OF THE DRAWINGS

Other features of the present invention will become apparent as the following description proceeds and upon reference to the drawings.

While the present invention will be described in connection with a preferred embodiment thereof, it will be understood that it is not intended to limit the invention to that embodiment. On the contrary, it is intended to cover all alternatives, modifications, and equivalents as may be included within the spirit and scope of the invention as defined by the appended claims.

DETAILED DESCRIPTION

While the present invention will be described in connection with a preferred embodiment thereof, it will be understood that it is not intended to limit the invention to that embodiment. On the contrary, it is intended to cover all alternatives, modifications, and equivalents as may be included within the spirit and scope of the invention as defined by the appended claims.

Figure 1:
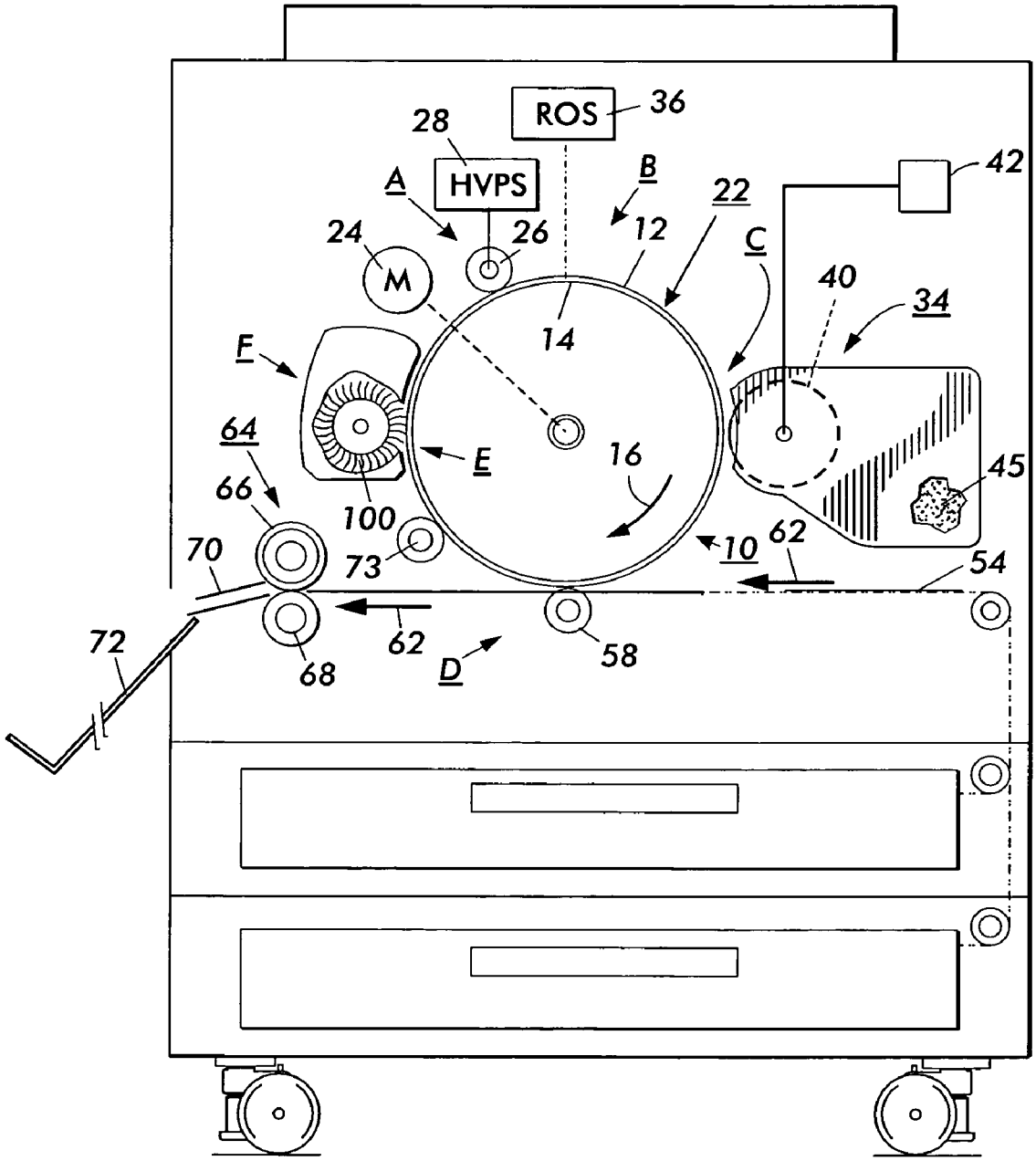
FIG. 1 is a schematic illustration of a printing apparatus incorporating the inventive features of the present invention.

For a general understanding of the illustrative electrophotographic printing machine incorporating the features of the present invention therein, reference is made to the drawings. In the drawings, like reference numerals have been used throughout to designate identical elements. FIG. 1 schematically depicts the various components of an electrophotographic printing machine incorporating the dual polarity electrostatic brush cleaner of the present invention therein. Although the dual polarity electrostatic brush cleaner of the present invention is particularly well adapted for use in the illustrative printing machine, it will become evident that the dual polarity electrostatic brush cleaner is equally well suited for use in a wide variety of printing machines and are not necessarily limited in its application to the particular embodiment shown herein.

Referring now to FIG. 1, the electrophotographic printing machine shown employs a photoconductive drum, although photoreceptors in the form of a belt are also known, and may be substituted therefor. The drum has a photoconductive surface deposited on a conductive substrate 14. The drum moves in the direction of arrow 16 to advance successive portions thereof sequentially through the various processing stations disposed about the path of movement thereof. Motor 24 rotates roll 22 to advance drum in the direction of arrow 16. Drum is coupled to motor 24 by suitable means such as a drive.

Initially successive portions of drum pass through charging station A. At charging station A, a corona generating device, in the form of a bias charge roll which is indicated generally by the reference numeral 26, charges the drum 10 to a selectively high uniform electrical potential, preferably negative. Any suitable control, well known in the art including for example HVPS 28, may be employed for controlling the corona generating device 26.

In a digital printing machine as shown in FIG. 1, the drum 10 passes through imaging station B where a ROS (Raster Optical Scanner) 36 may lay out the image in a series of horizontal scan lines with each line having a specific number of pixels per inch. The ROS 36 may include a laser (not shown) having a rotating polygon mirror block associated therewith. The ROS 36 exposes the photoconductive surface 12 of the drum.

It should be appreciated that the printing machine may alternatively be a light lens copier. In a light lens copier a document to be reproduced is placed on a platen, located at the imaging station, where it is illuminated in known manner by a light source such as a tungsten halogen lamp. The document thus exposed is imaged onto the drum by a system of mirrors. The optical image selectively discharges the surface of the drum in an image configuration whereby an electrostatic latent image of the original document is recorded on the drum at the imaging station.

At development station C, a development system or unit, indicated generally by the reference numeral 34 advances developer materials into contact with the electrostatic latent images. Preferably, the developer unit includes a developer roller mounted in a housing. Thus, developer unit 34 contains a developer roller 40. The roller 40 advances toner particles 45 into contact with the latent image. Appropriate developer biasing may be accomplished via power supply 42, electrically connected to developer unit 34.

The developer unit 34 develops the discharged image areas of the photoconductive surface. This developer unit contains magnetic black toner particles 45, for example, which are charged by the electrostatic field existing between the photoconductive surface and the electrically biased developer roll in the developer unit. Power supply 42 electrically biases the magnetic roll 40.

It should be evident that the present invention may be employed in a color printing machines; and as well in one component and two component development systems.

A sheet of support material 54 is moved into contact with the toner image at transfer station D. The sheet of support material is advanced to transfer station D by a suitable sheet feeding apparatus, not shown. Preferably, the sheet feeding apparatus includes a feed roll contacting the uppermost sheet of a stack of copy sheets. Feed rolls rotate so as to advance the uppermost sheet from the stack into a chute which directs the advancing sheet of support material into contact with the photoconductive surface of drum 10 in a timed sequence so that the toner powder image developed thereon contacts the advancing sheet of support material at transfer station D.

Transfer station D includes a corona generating device 58 in the form of a bias charge roll, which applies ions of a suitable polarity onto the backside of sheet 54. This attracts the toner powder image from the drum 10 to sheet 54. After transfer, the sheet continues to move, in the direction of arrow 62, onto a conveyor (not shown) which advances the sheet to fusing station.

Fusing station includes a fuser assembly, indicated generally by the reference numeral 64, which permanently affixes the transferred powder image to sheet 54. Preferably, fuser assembly 64 comprises a heated fuser roller 66 and a pressure roller 68. Sheet 54 passes between fuser roller 66 and pressure roller 68 with the toner powder image contacting fuser roller 66. In this manner, the toner powder image is permanently affixed to sheet 54. After fusing, a chute 70 guides the advancing sheet 54 to a catch tray 72 for subsequent removal from the printing machine by the operator. It will also be understood that other post-fusing operations can be included, for example, stapling, binding, inverting and returning the sheet for duplexing and the like.

After the sheet of support material is separated from the photoconductive surface of drum 10, the residual toner particles carried by image and the non-image areas on the photoconductive surface are removed at cleaning station F. The vacuum assisted, electrostatic, brush cleaner unit or cleaning blade is disposed at the cleaning station F to remove any residual toner remaining on the surface of the drum.

It is believed that the foregoing description is sufficient for purposes of the present application to illustrate the general operation of an electrophotographic printing machine incorporating the cleaning apparatus of the present invention therein.

According to the present invention and referring now to FIG. 1, cleaning station F, invariably, after the toner powder image has been transferred to the sheet of paper, residual toner particles remain adhering to the exterior surface of photoconductive drum 10. At cleaning station F, the residual toner particles are removed from photoconductive drum 10. Cleaning station F includes cleaner brush 100, the brush 100 rotates in the direction of the respective arrow 101. Brush 100 has a detoning roll 110, to remove residual particles from the cleaner brush. The detoning roll 110 rotates in a direction shown by the arrow 111. Scraper blade 112 removes the particles from the detoning roll 110 and guides these removed particles into a waste receptacle (not shown). It should be evident the present invention is applicable to cleaning systems where vacuum detone is used instead of bias roll detone.

Figure 2:
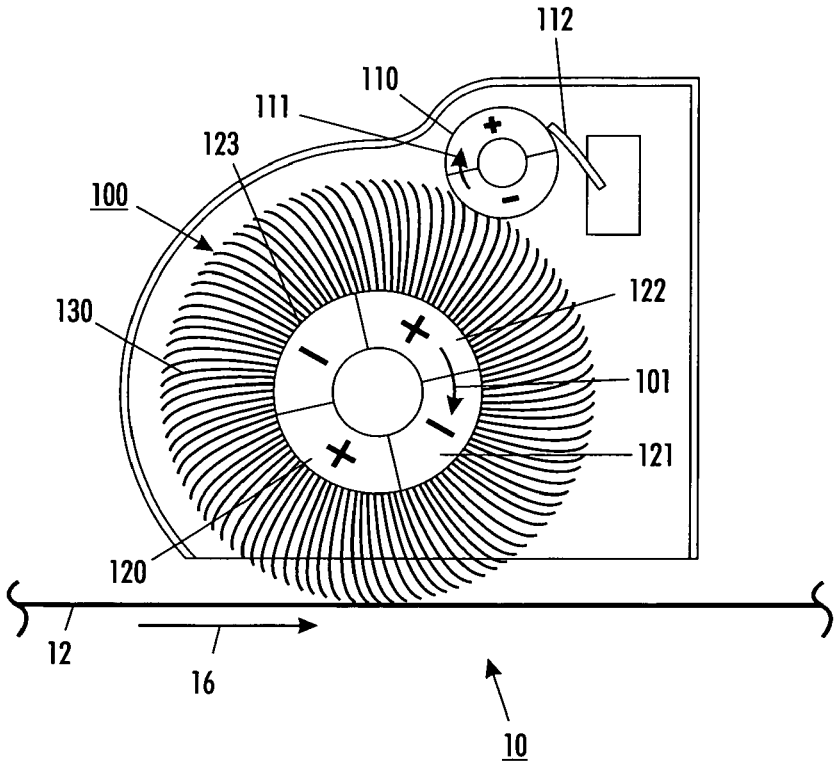
FIG. 2 shows the cleaning device of the present invention.
Figure 3:
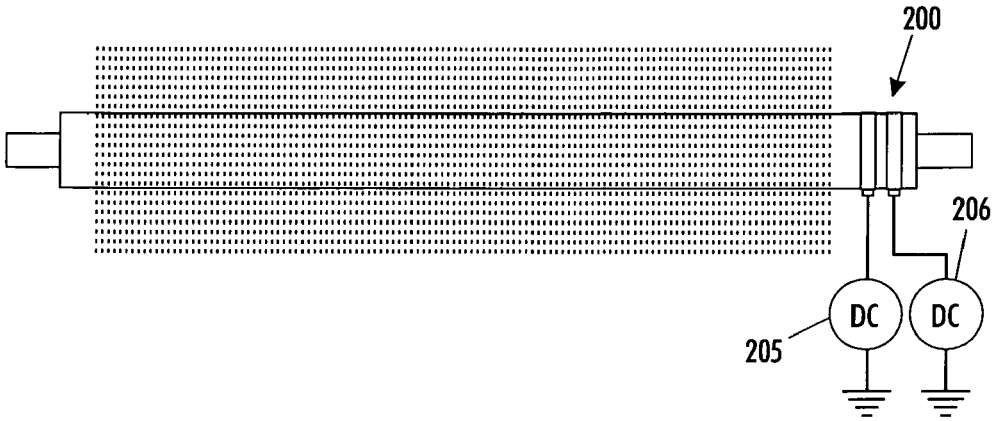
FIG. 3 is a sideview of the cleaning device of the present invention.

Cleaning brush 100 includes a conductive core which is segment into brush segments 120, 121, 122, and 123 (four quadrants are shown for illustration purposes it should evident that more or less quadrants could be used), so that brush pile fibers 130 connected to the core in brush segments 120, 121, 122, and 123 can be biased both positively and negatively. Brush segments are biased through commutated contacts 200 and isolated by insulator (not shown) from each other to prevent shorting when biased to opposite polarities. Detoning roll 110 can be segmented as well (as shown in FIG. 2), or the brush pile segment polarities can be reversed between cleaning and detoning against a grounded conventional detoning roll.

The dual polarity single brush cleaner of the present invention can be used to clean both right and wrong sign toner. Use of a single brush cleaner avoids the additional costs and space needed for a conventional dual brush cleaner.

In operation, power supply 205 and power supply 206 applies a bias of opposite polarity to commutated contacts 200, which allows brush segments 120, 121, 122, and 123 to be biased both positively and negatively. As residual toner coming out of region D is negatively charged by the negative preclean 73, the brush 100, rotating against the direction of motion, shown by arrow 16, of the photoreceptor drum 10, brush segment 120 is positively biased to remove negatively charged toner particles in residual region E. No residual toner should get to region B—that is past the bias charging roll and any toner that got to B from the cleaner would contaminate the BCR from the photoreceptor drum 10. Toner cleaned from toner region E is detoned from the brush segments by segments of detoning roll 110 having the opposite polarity. The toner particles not removed (ie. "wrong sign" toner) by the first positively biased brush segment, on the photoreceptor belt 10, are removed by the first negatively biased brush segment. The toner in cleaning brush segment is then removed by oppositely charged segment 105 of detoning roll 110.

It is, therefore, apparent that there has been provided in accordance with the present invention, that fully satisfies the aims and advantages hereinbefore set forth. While this invention has been described in conjunction with a specific embodiment thereof, it is evident that many alternatives, modifications, and variations will be apparent to those skilled in the art. Accordingly, it is intended to embrace all such alternatives, modifications and variations that fall within the spirit and broad scope of the appended claims.

What is claimed is:

1. An apparatus for removing charged particles from a surface, the surface being capable of movement, comprising:

a conductive brush in contact with said surface, said conductive brush having a first region thereof having a first polarity and a second region having a second polarity; and means for biasing said conductive brush; and a detoning member for cleaning said conductive brush;

said detoning member segment into a first portion having said first polarity for cleaning the second region of the conductive brush and a second portion having a second polarity for cleaning the first region of the conductive brush.

2. An apparatus as recited in claim 1, wherein said conductive brush includes a core and conductive fibers attached thereto, said core being electrically segmented into said first region and said second region.

3. An apparatus as recited in claim 2, wherein said biasing means includes a commutator electrically connected to said core and a power supply for applying a bias to said commutator.

4. An apparatus as recited in claim 2, wherein said first region being positively charged, removes the negative triboelectrically charged particles from the surface.

5. An apparatus as recited in claim 1, wherein said second region, being negatively charged removes the positive triboelectrically charged particles from the surface.

6. An apparatus as recited in claim 1, wherein said first polarity comprises a negative charge.

7. An apparatus as recited in claim 1, wherein said second polarity comprises a positive charge.

8. An apparatus as recited in claim 1, further comprising:

a housing for holding said conductive brush being partially enclosed therein.

9. An apparatus for removing charged particles from a surface, the surface being capable of movement, comprising:

a conductive brush in contact with said surface, said conductive brush having a first region thereof having a first polarity and a second region having a second polarity; and means for biasing said conductive brush;

a detoning member for cleaning said conductive brush; and a controller for changing the polarity of said detoning member from said first polarity to said second polarity when said opposite polarity region on said conductive brush passes thereby.

* * * * *